US012435722B2

(12) United States Patent
James et al.

(10) Patent No.: US 12,435,722 B2
(45) Date of Patent: Oct. 7, 2025

(54) VACUUM PRIMING SYSTEM FOR CLOSE-COUPLED PUMPS

(71) Applicant: Cornell Pump Company LLC, Clackamas, OR (US)

(72) Inventors: Seth Michael James, Colton, OR (US); Jordan Russell White, Canby, OR (US)

(73) Assignee: Cornell Pump Company LLC, Clackamas, OR (US)

( * ) Notice: Subject to any disclaimer, the term of this patent is extended or adjusted under 35 U.S.C. 154(b) by 86 days.

(21) Appl. No.: 18/297,727

(22) Filed: Apr. 10, 2023

(65) Prior Publication Data

US 2023/0323882 A1 Oct. 12, 2023

Related U.S. Application Data

(60) Provisional application No. 63/329,552, filed on Apr. 11, 2022.

(51) Int. Cl.
*F04D 9/04* (2006.01)
*F04D 9/00* (2006.01)
(Continued)

(52) U.S. Cl.
CPC ..... *F04D 9/041* (2013.01); *F04D 9/045* (2013.01); *F04D 9/048* (2013.01);
(Continued)

(58) Field of Classification Search
CPC ..... F04D 9/041; F04D 9/045; F04D 9/048; F04D 13/0686; F04D 29/605; F04D 9/004; F04D 9/043; F04D 13/021
See application file for complete search history.

(56) References Cited

U.S. PATENT DOCUMENTS 1,995,812 A * 3/1935 Noble ..... F04D 9/046 417/202
3,469,528 A * 9/1969 East ..... F04D 9/02 200/81.9 R
(Continued)

FOREIGN PATENT DOCUMENTS

CN 2929264 Y 8/2007
CN 112576518 A 3/2021
CN 113833667 A 12/2021

OTHER PUBLICATIONS

"Power Primer," Protek Specialty Co, accessed Apr. 10, 2023 at <https://www.protekspecialty.com/power-primer/>.

*Primary Examiner* — David N Brandt
(74) *Attorney, Agent, or Firm* — Fish & Richardson P.C.

(57) ABSTRACT

Systems and methods described herein provide a vacuum priming system for close-coupled pumps. The vacuum priming system is mounted separately from a centrifugal pump and powered by an electric motor. An auxiliary vacuum pump pulls prime (e.g., water or another liquid) through a solenoid valve that is in turn connected to a connecting tube. At one end of the connecting tube is a screen and prime sensor. The screen filters particulates to protect the vacuum pump, and the prime sensor may detect when the centrifugal pump is primed. The vacuum priming system includes a self-contained control panel with an auto operation mode to only pull power during priming, reducing power consumption over the lifetime of the pump system and improving efficiency.

20 Claims, 8 Drawing Sheets

(51) Int. Cl.
*F04D 13/02* (2006.01)
*F04D 13/06* (2006.01)
*F04D 29/60* (2006.01)

(52) U.S. Cl.
CPC ..... *F04D 13/0686* (2013.01); *F04D 29/605* (2013.01); *F04D 9/004* (2013.01); *F04D 9/043* (2013.01); *F04D 13/021* (2013.01)

(56) References Cited

U.S. PATENT DOCUMENTS

| | | | | |
|---|---|---|---|---|
| 4,067,663 | A * | 1/1978 | Brooks | F04D 9/045 417/199.2 |
| 4,743,430 | A * | 5/1988 | Spielholz | B05B 7/0025 417/364 |
| 6,152,689 | A * | 11/2000 | Yokota | F04D 15/0005 417/199.2 |
| 6,682,313 | B1 | 1/2004 | Sulmone | |
| 7,874,808 | B2 | 1/2011 | Stiles | |
| 7,931,447 | B2 | 4/2011 | Levin et al. | |
| 8,469,675 | B2 | 6/2013 | Stiles et al. | |
| 8,662,044 | B2 | 3/2014 | Becker et al. | |
| 8,932,003 | B2 | 1/2015 | Kim | |
| 8,998,586 | B2 | 4/2015 | Muhs | |
| 9,568,005 | B2 | 2/2017 | Robol et al. | |
| 9,587,641 | B2 | 3/2017 | Mettler et al. | |
| 9,868,004 | B1 | 1/2018 | Crawley | |
| 9,889,243 | B2 | 2/2018 | Kelly et al. | |
| 10,054,115 | B2 * | 8/2018 | Seith | F04B 43/0081 |
| 10,675,560 | B2 * | 6/2020 | Kawamoto | B01D 19/00 |
| 10,973,180 | B2 | 4/2021 | Qiu et al. | |
| 2002/0114707 | A1 * | 8/2002 | Carnes | F04D 9/043 417/200 |
| 2020/0158115 | A1 | 5/2020 | Mei | |

* cited by examiner

VACUUM PRIMING SYSTEM FOR CLOSE-COUPLED PUMPS

CROSS-REFERENCE TO RELATED APPLICATION

This application claims priority to under 35 U.S.C. § 119, based on U.S. Provisional Patent Application No. 63/329,552 filed Apr. 11, 2022, titled "Vacuum Priming System for Close-Coupled Pumps," the disclosure of which is hereby incorporated by reference.

BACKGROUND OF THE INVENTION

Centrifugal pumps are the most common pumps for moving liquids from place to place and are used in irrigation, domestic water systems, and many other applications. Liquid is urged through the pump by a spinning disk-shaped impeller positioned inside an annular volute. The volute typically has an eye at the center where water enters the pump and is directed into the center of the impeller. The rotation of the impeller slings the liquid outward to the perimeter of the impeller where it is collected for tangential discharge. As the liquid is driven outward, a vacuum is created at the eye, which tends to draw more fluid into the pump.

One of the basic limitations on the use of centrifugal pumps is their limited ability to draw fluid for priming when starting from an air-filled or dry condition. The impeller, which is designed to pump liquids, often cannot generate sufficient vacuum when operating in air to draw liquid up to the pump when the standing level of the liquid is below the eye of the pump. Once the liquid reaches the eye, the outward motion of the liquid away from the eye creates the vacuum necessary to draw a continuing stream of liquid. However, until liquid reaches the impeller, very little draw is generated.

In many applications, to begin pumping, the pump must first self-prime by drawing water up to the pump from a low water lever or the pump must be manually primed by being filled with water from a secondary source. Since manual priming requires user intervention, it is generally preferable that the pump be capable of self-priming. This is particularly true in applications, such as irrigation, where pump operation is intermittent and the need for priming recurrent. To supplement the limited capability of the spinning impeller to generate vacuum, an auxiliary vacuum pump can be provided to be used with centrifugal pumps.

DETAILED DESCRIPTION OF EXAMPLE EMBODIMENTS

Figure 1:
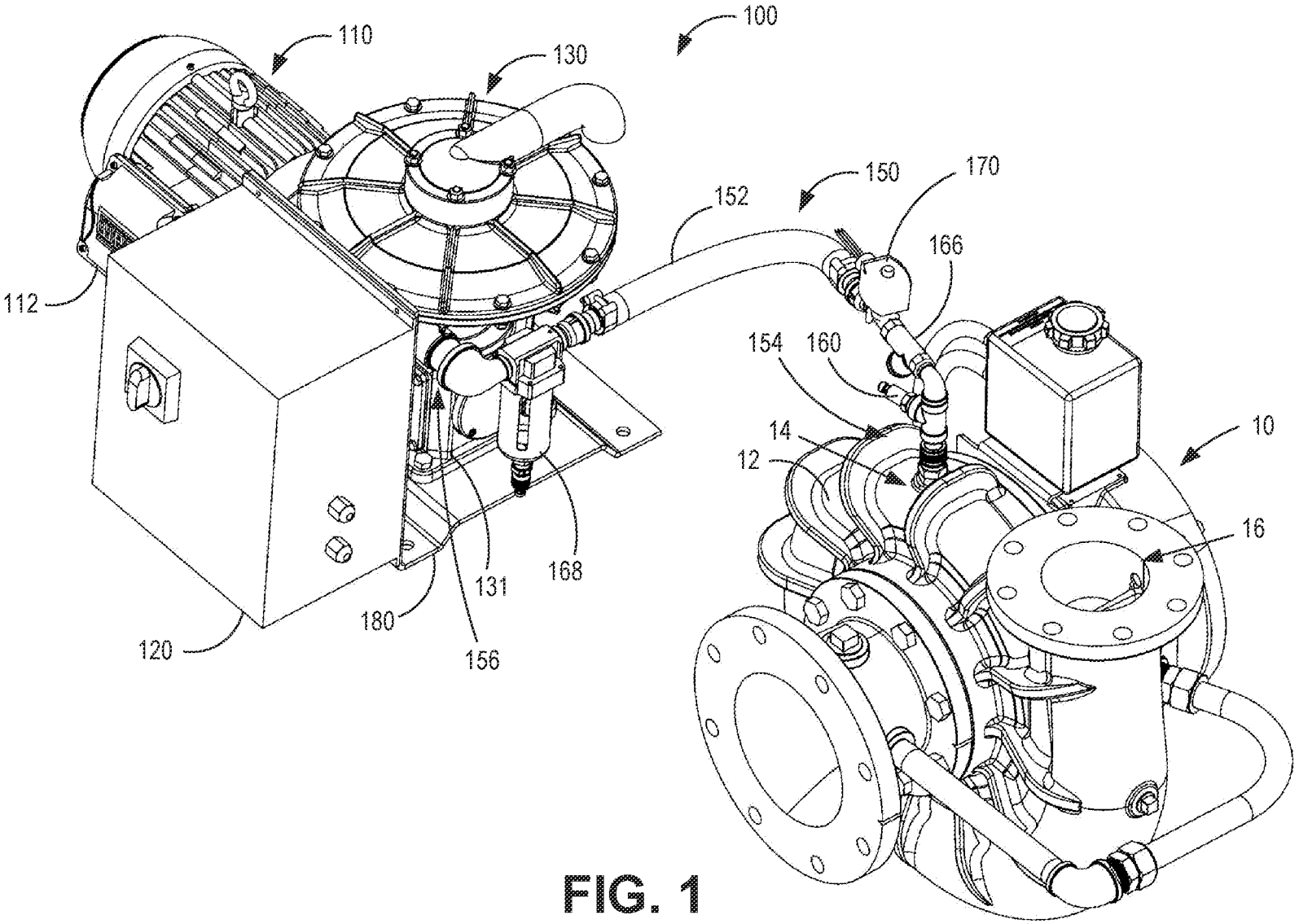
FIG. 1 is a perspective view of an assembly including a vacuum priming system connected to a centrifugal pump, according to an implementation described herein.

The following detailed description refers to the accompanying drawings. The same reference numbers in different drawings may identify the same or similar elements. Also, the following detailed description does not limit the invention.

Currently, there is no option for a self-sustaining priming system for close-coupled pump units. Traditionally, an auxiliary vacuum pump for priming has been mounted on top of a frame for the centrifugal pump. In such arrangements, the vacuum pump is powered via a belt drive using the centrifugal pump shaft with vacuum flow controlled by, for example, a float box mounted to the suction of the vacuum pump. However, in close-coupled pump units, there is no space to connect a separate drive belt to a pump shaft. Close-coupled pumps are currently primed with a manual priming system, which relies on an operator being present during startup, and if the unit loses prime during operation, an operator must return to the site to re-prime the pump. Otherwise, the close-coupled pump will run dry causing damage to the pump and other components.

Systems and methods described herein provide a vacuum priming system for close-coupled pumps. More particularly, a vacuum priming system is mounted separately from a centrifugal pump and powered by an electric motor. An auxiliary vacuum pump pulls prime (e.g., water or another liquid) through a solenoid valve that is in turn connected to a connecting tube. At one end of the connecting tube is a screen and prime sensor. The screen may filter particulates to protect the vacuum pump, and the prime sensor may detect when the centrifugal pump is primed. The vacuum priming system may also include a self-contained control panel with on/off/auto operation modes.

The solenoid valve may be configured in a normally closed state. In the auto operation mode, the control panel energizes the solenoid valve and motor when the prime sensor does not detect the presence of fluid or pressure indicative of a primed state. Energizing the motor will allow the vacuum pump to operate to pull a vacuum on the centrifugal pump casing in order to prime it with fluid. Once fluid/pressure is detected at the prime sensor, the solenoid valve may be de-energized (e.g., closed) and the motor may be turned off. The centrifugal pump is then allowed to operate as designed. If the prime sensor detects that the water level or pressure level drops (e.g., indicating the centrifugal pump loses prime), the vacuum priming system will repeat the process as needed until the control panel is eventually switched to an "off" mode. In the "on" operation mode, the system will continuously pull a vacuum with the solenoid valve open until the operation mode is switched to one of the "off" or "auto" modes.

According to an implementation, the vacuum priming system can be easily retro-fitted to any existing pump application. That is, while the vacuum priming system described herein is well-suited for close-coupled pumps, the vacuum priming system may be equally effective for pumps that could otherwise accommodate a traditional frame-mounted unit with shaft tie-in. The vacuum priming system is portable and can be adapted to be remotely monitored from the electrical outputs. The vacuum priming system may be added to a centrifugal pump system without having to make significant upgrades to a product currently in use. The vacuum priming system may allow for remote control. Furthermore, the vacuum priming system may be self-sufficient and is not reliant on manual operator intervention to maintain operation.

Figure 2:
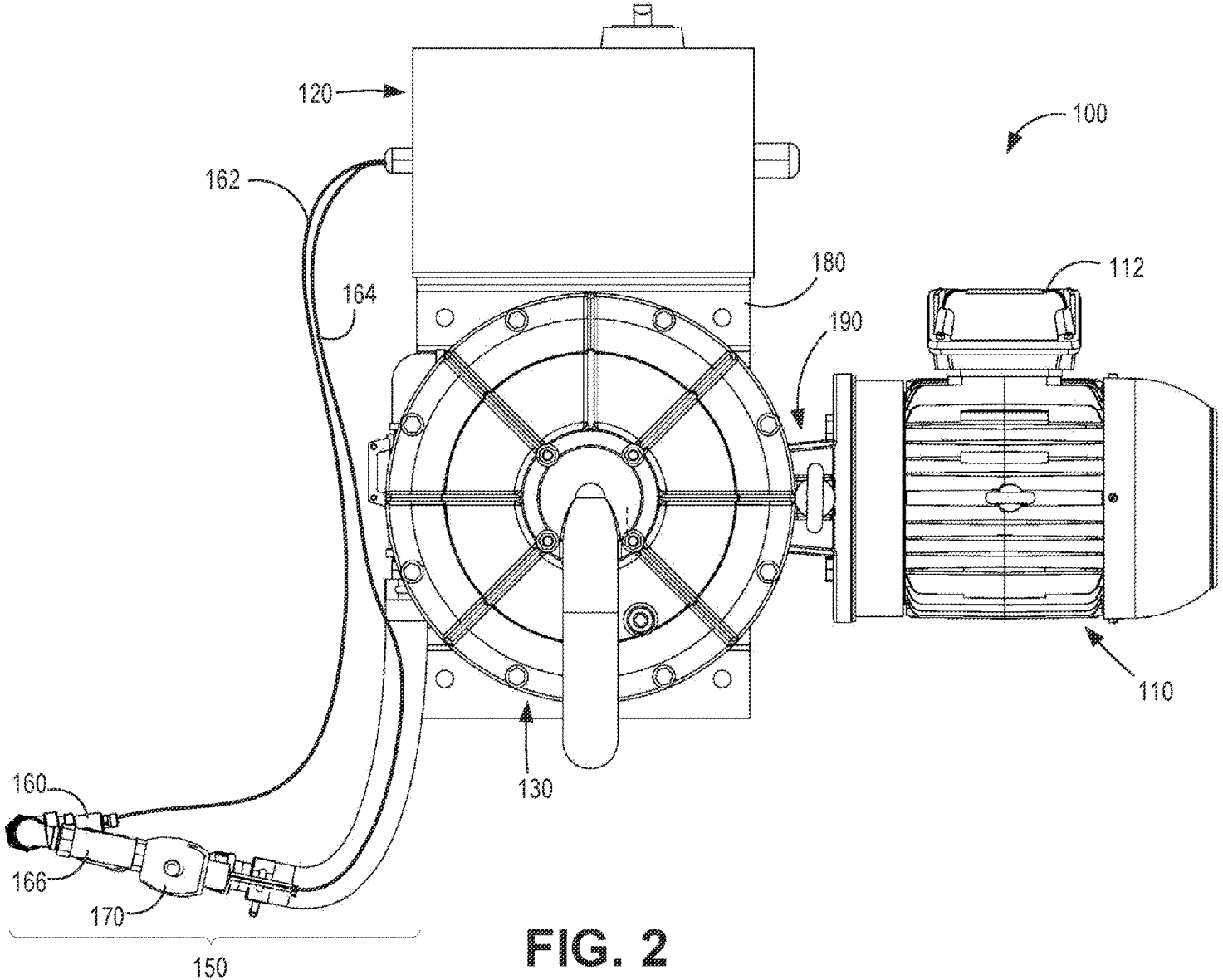
FIG. 2 is a top view of the vacuum priming system of FIG. 1.
Figure 3:
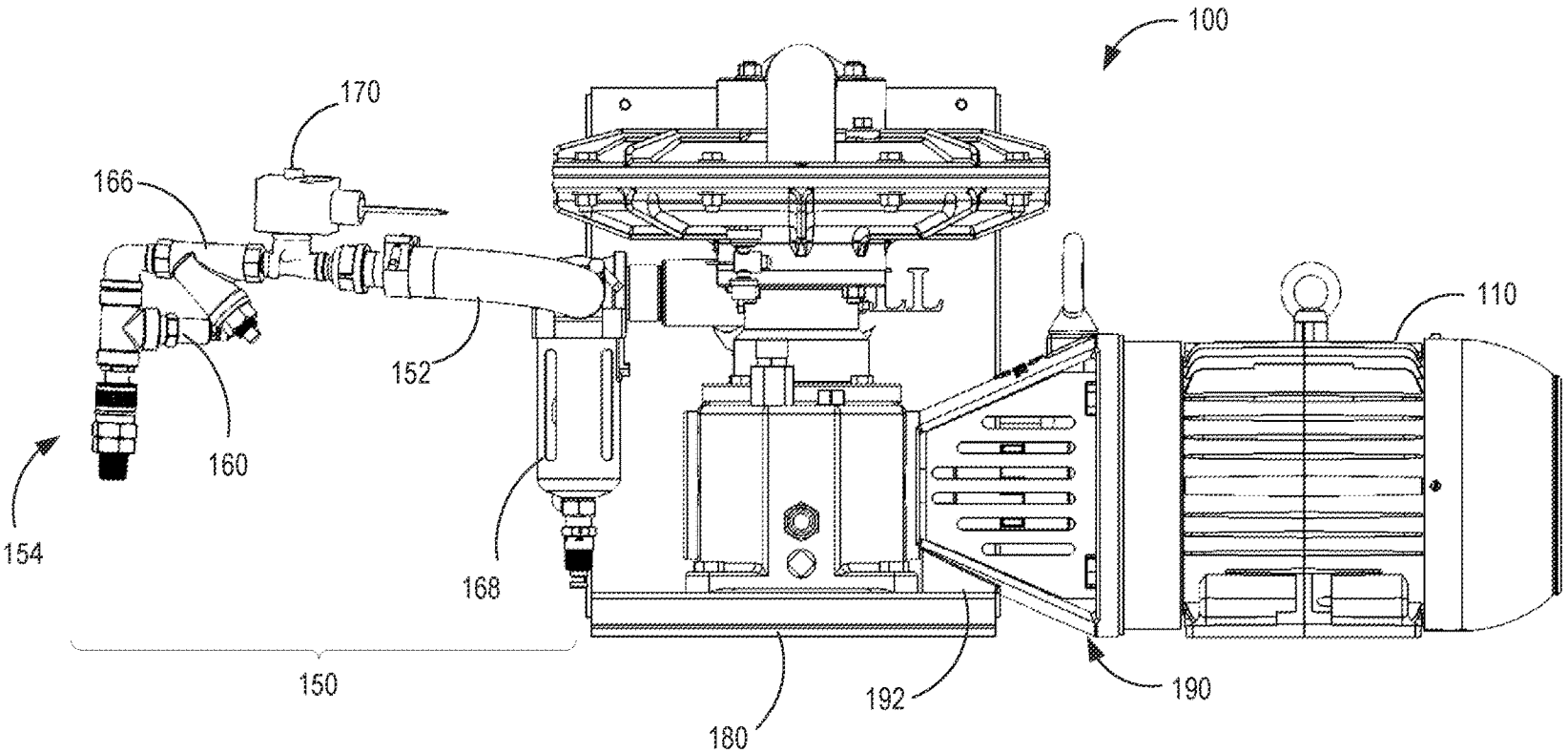
FIG. 3 is a side view of the vacuum priming system of FIG. 1.

FIG. 1 is a perspective view of a vacuum priming system 100, according to an implementation described herein, connected to a centrifugal pump 10. FIGS. 2 and 3 are top and side views, respectively, of vacuum priming system 100. Vacuum priming system 100 may include a motor 110, a controller 120, a vacuum pump 130, and a suction assembly 150.

Centrifugal pump 10 may be a standard centrifugal pump with a sealing system that allows the pump to safely run dry for extended periods of time. Centrifugal pump 10 may include an oil reservoir to provide cooling. While centrifugal pump 10 will efficiently pump water or other liquids, it will not draw significant vacuum when operated dry. Instead, when centrifugal pump 10 is dry, priming may be accomplished with vacuum priming system 100.

Motor 110 may include a small electric motor (e.g., a 2 HP motor) configured to run vacuum pump 130. According to an implementation, motor 110 may be operated separately from and/or independently of centrifugal pump 10 (i.e., the main pump). Motor 110 may be powered by a power source (e.g., the same power source that operates centrifugal pump 10) that can be selectively engaged by controller 120. For example, motor 110 may include a motor controller 112 to control that activates/deactivates motor 110. According to an implementation, motor 110 and vacuum pump 130 may be selectively engaged and disengaged, such that motor 110 and vacuum pump 130 only operate during priming operations.

Controller 120 may include one or multiple processors, microprocessors, or microcontrollers that interpret and execute instructions, and/or may include logic circuitry (e.g., a field-programmable gate array (FPGA), an application specific integrated circuit (ASIC), etc.) that executes one or more processes/functions. Controller 120 may include communication ports for receiving and sending data, including sending control instructions and receiving control acknowledgements, from components of vacuum priming system 100. According to an embodiment, controller 120 may include logic that provides automated vacuum priming for centrifugal pump system 10.

Figure 7:
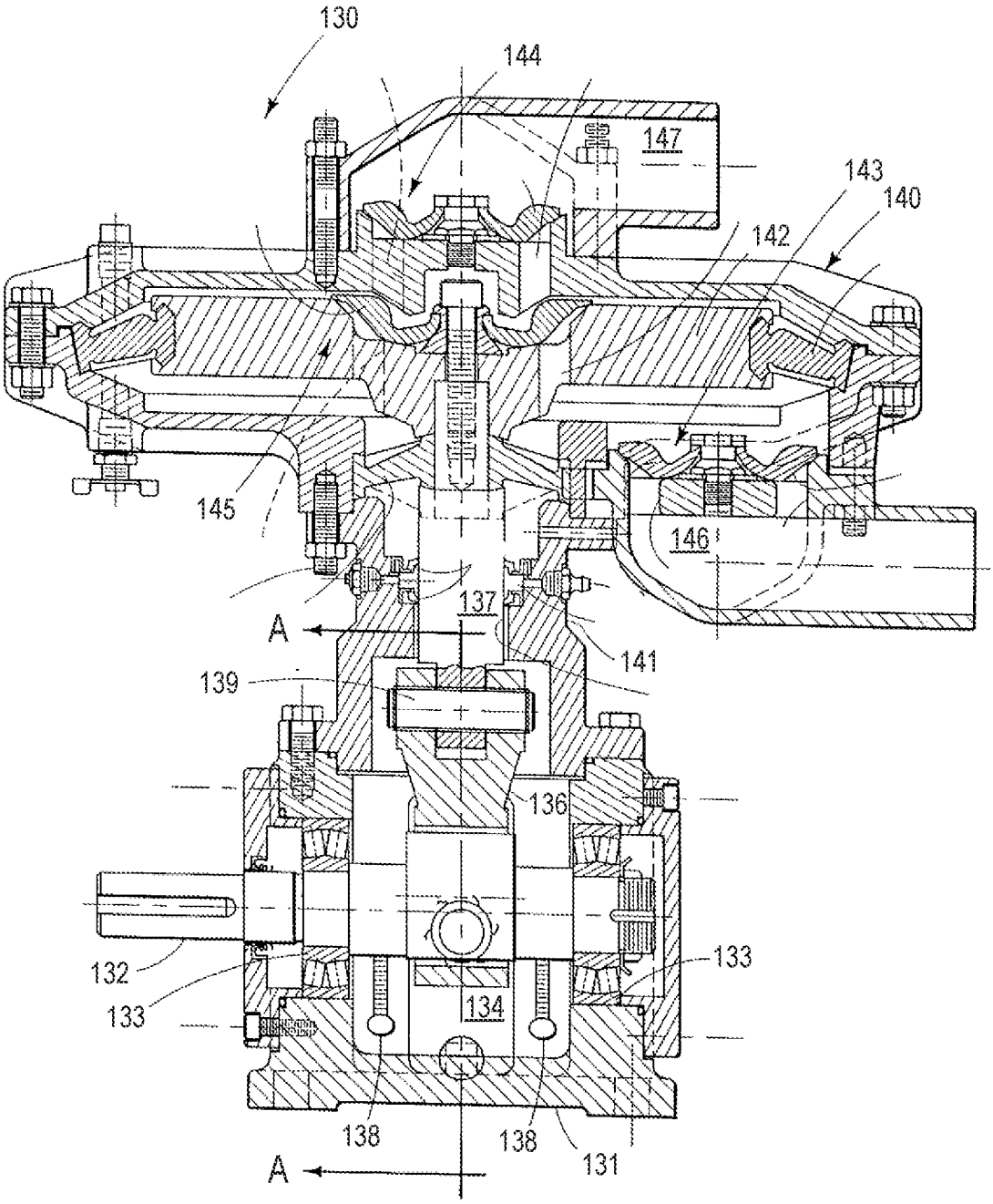
FIG. 7 is side cross-sectional view of a vacuum pump for the vacuum priming system of FIG. 1.

Vacuum pump 130 may include a positive displacement-type pump that is configured to draw a vacuum. Vacuum pump 130 may be mounted to a base plate 180. A housing or base 131 is bolted to base plate 180 and supports a shaft 132 on bearings 133 (e.g., see FIGS. 7 and 8). Base 131 also contains an oil reservoir 134. Shaft 132 projects through one end of base 131 and may be coupled to motor 110. Thus, engagement of motor 110 turns shaft 132. A combined bracket/coupling guard 190 may cover a coupling between motor 110 and shaft 132.

Figure 8:
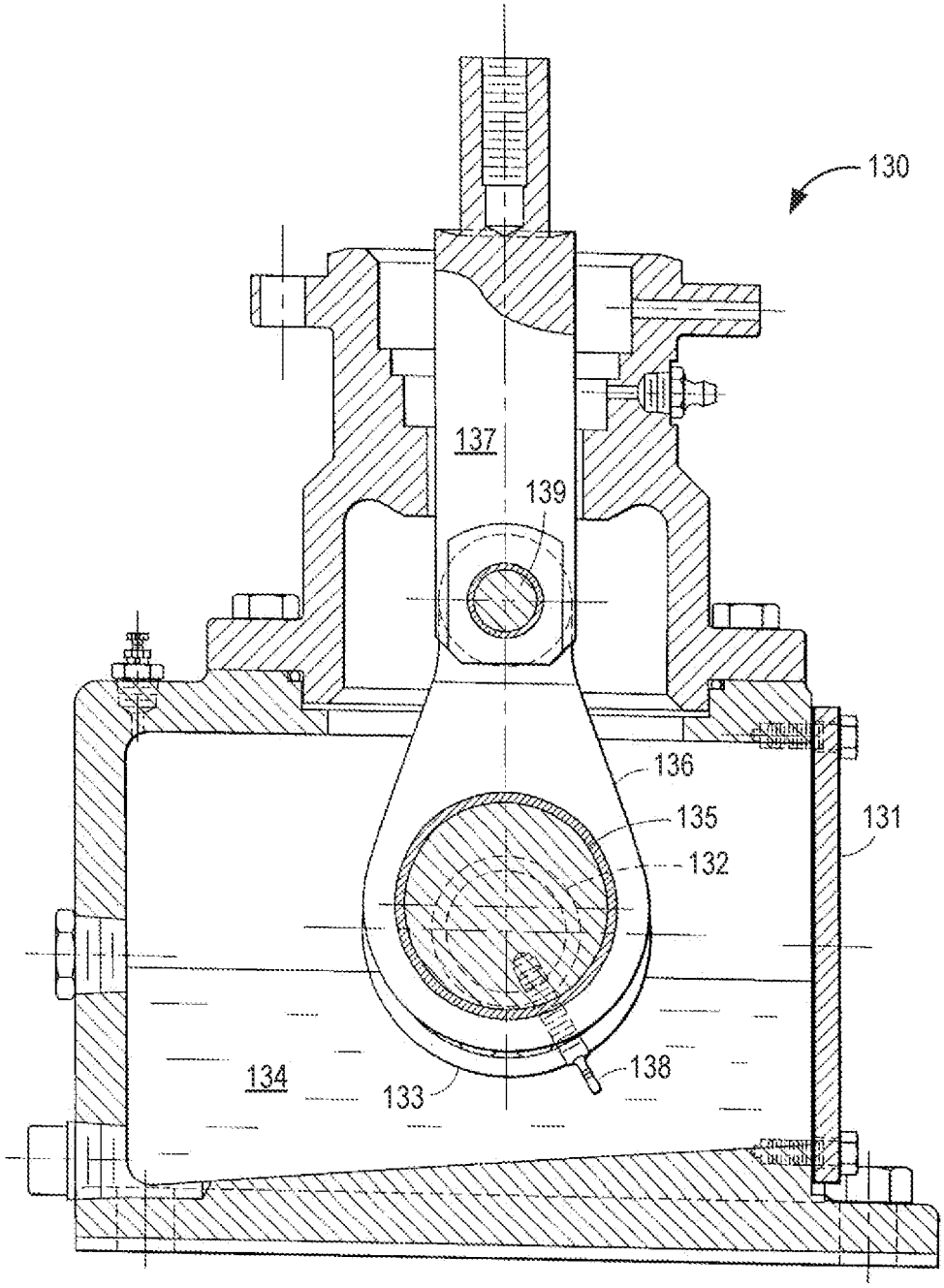
FIG. 8 is a partial cross-sectional view of a part of the vacuum pump taken along lines A-A in FIG. 7.

According to an implementation, vacuum pump 130 includes an oil delivery system to distribute oil from oil reservoir 134 to ensure rapid lubrication upon each start. As shown in FIG. 8, shaft 132 may include an eccentric section 135 to which is mounted a connecting rod 136. Connecting rod 126 is tied to a slider 137 by a pin 139. An oil delivery system in the form of one or more oil slingers 138 (also referred to herein as members) attached to shaft 132 throws oil in oil reservoir 134 up, above reservoir 134, onto the connecting rod 136, slider 137, and pin 139 to insure adequate lubrication. According to an implementation, each slinger 138 may be rigid and similar to a thumb screw screwed into shaft 132. In other implementations, slingers 138 may have other configurations, such as flexible strips or a partially submerged disk which could likewise flip oil onto components above the oil level in oil reservoir 134.

Slider 137 extends upward through a sleeve section 141 that is bolted to the top of base 131. A diaphragm housing 140 is mounted to the top of sleeve 141 and encloses a pump chamber that houses a diaphragm 142. Diaphragm 142 is mounted to the top of slider 137 and is driven up and down with the slider when shaft 132 rotates. As diaphragm 142 moves up and down in the pump chamber, air is moved by operation of check valves 143, 144, 145 to generate a vacuum through intake port 146 and expel air through output port 147.

Suction assembly 150 may connect intake port 146 of vacuum pump 130 to a volute casing 12 of centrifugal pump 10. When vacuum pump 130 is engaged/operating, vacuum pump 130 may provide suction through suction assembly 150 to draw liquid (e.g., water) into volute casing 12 of the centrifugal pump for priming.

Figure 4:
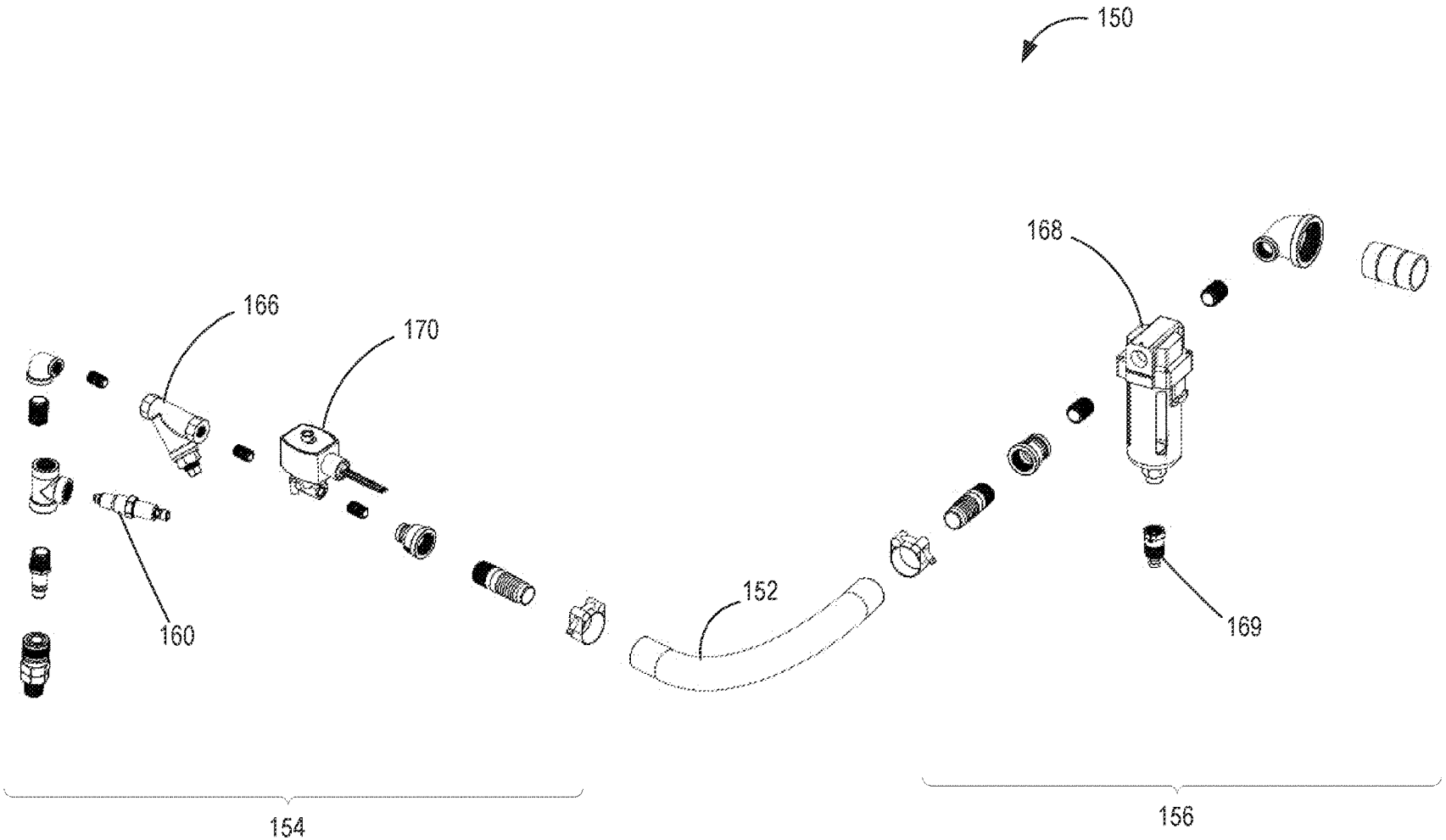
FIG. 4 is an exploded view of a suction assembly for the vacuum priming system.

FIG. 4 is an exploded view of suction assembly 150. Referring collectively to FIGS. 1-4, suction assembly 150 may include a volute end section 154 and a vacuum end section 156 on either end of a hose or tube 152. Volute end section 154 may connect one end of tube 152 to volute casing 12. Vacuum end section 156 may connect another end of tube 152 to vacuum pump 130. According to an implementation, volute casing 12 may include an opening 14 that extends through a top portion (e.g., as oriented in FIG. 1) of volute casing 12. Opening 14 may be located at a high-point or threshold, such that rising liquid levels in the volute casing would approach opening 14 when the volute casing is filled. Suction assembly 150 (including sections 156 and 154) may permit fluid communication between volute casing 12 and vacuum pump 130. According to an implementation, suction assembly 150 may include a prime sensor 160 and a solenoid valve 170. Controller 120 may use prime sensor 160 and solenoid valve 170 to selectively control vacuum through tube 152.

Prime sensor 160 may detect a change at volute casing 12 or suction assembly 150 to indicate entry or exiting of a primed state. Prime sensor 160 may be connected, for example, at volute end section 154. In one implementation, prime sensor 160 may be a liquid level sensor configured to detect liquid (e.g., water) at or near opening 14 of volute casing 12. For example, prime sensor 160 may be configured to detect when the water level inside volute casing 12 reaches opening 14, indicating that centrifugal pump 10 is primed. When implemented as a level sensor, prime sensor 160 may include, for example, a liquid level sensor, such as a self-calibrating capacitive level sensor. In other implementations, the level sensor may be implemented, for example, as an ultrasonic level sensor, etc.

When implemented as a pressure sensor, prime sensor 160 may be located at a different portion of centrifugal pump 10. For example, prime sensor 160, in the form of a pressure sensor may be located at a discharge port 16 of centrifugal pump 10. The pressure sensor may detect a discharge pressure for volute casing 12, such as would be indicative of whether or not impellers in the volute casing are pushing out fluid. In other embodiments, prime sensor 160 may include a different type of sensor to detect when volute casing enters or exits a primed state.

Prime sensor 160 may include a communication interface to transfer sensor data to controller 120. According to an implementation, prime sensor 160 may transfer sensor readings to controller 120 via a wired connection (e.g., extending through a conduit 162, shown in FIG. 2) connected between prime sensor 160 and controller 120. According to another implementation, prime sensor 160 may transfer measurement readings to controller 120 via a wireless signal, using a short-range wireless standard, such as a Bluetooth connection. Controller 120 may receive measurement data from prime sensor 160. For example, controller 120 may receive continuous fluid level readings or periodic fluid level readings.

Solenoid valve 170 may be connected, for example, at volute end section 154. For example, solenoid valve may be positioned between a Y-strainer 166 and tube 152. Solenoid valve 170 may be configured to open and close fluid access through suction assembly 150/tube 152. According to an implementation, solenoid valve 170 may include a communication interface to receive commands from controller 120 and provide valve state information (e.g., open/closed) to controller 120. Solenoid valve 170 may receive actuation signals from and/or send data to controller 120 via a wired connection (e.g., included in a conduit 164, shown in FIG. 2) between solenoid valve 170 and controller 120. According to another implementation, solenoid valve 170 may receive actuation signals from controller 120 via a wireless signal, using a short-range wireless standard.

According to an implementation, solenoid valve 170 may be configured in a normally closed state that prevents fluid flow through tube 152 (e.g., preventing suction from vacuum pump 130 into volute casing 12). When energized, solenoid valve 170 may switch to an open state to permit vacuum suction through suction assembly 150. In another implementation, another type of valve/actuator may be used for solenoid valve 170.

In one embodiment, volute end section 154 may include Y-strainer 166 to catch contaminants exiting from opening 14 prior to entering into vacuum tube 152. The Y-strainer 166 may be connected, for example, in-line between volute casing 12 and tube 152.

Additionally, a water separator (or catch can) 168 may be installed along suction assembly 150 to prevent moisture (e.g., water particles from volute casing 12) from entering intake port 146 of vacuum pump 130. Water separator 168 may be connected, for example, in vacuum end section 156 between vacuum pump 130 and tube 152. Water separator 168 may be configured to remove water from a vacuum. According to an implementation, a low-cracking-pressure spring check valve 169 may be included with water separator 168. Water separator 168 may also include a 3-way valve implemented in valve 170, for example. When there is a vacuum in assembly 150, the check valve 169 is held closed. After priming is achieved, valve 170 switches to atmospheric and releases the vacuum being held in the hose 152. This allows whatever water is accumulated in water separator 168 to be released. Check valve 169 is configured with a light enough spring to hold just closed, but able to release when just a few inches of water are collected.

FIGS. 1-4 show one arrangement for components of suction assembly 150 connected in series. In other implementations, components of suction assembly 150 may be arranged differently. For example, in another embodiment, one or more of prime sensor 160, Y-strainer 166, or solenoid valve 170 may be installed in vacuum end section 156.

Figure 5:
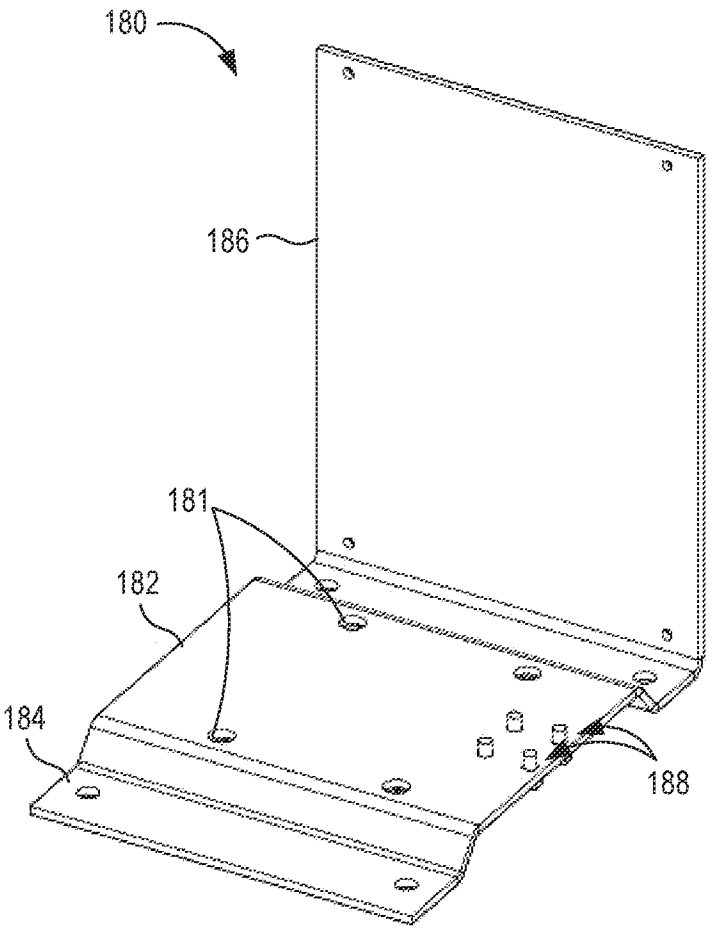
FIG. 5 is a perspective view of a base plate for the vacuum priming system.

Controller 120 and vacuum pump 130 may be mounted on base plate 180, shown, for example, in FIG. 5. Base plate 180 may be separate and independent from centrifugal pump 10. Thus, the proximity of vacuum priming system 100 to centrifugal pump 10 may primarily be governed by the configurable length of vacuum tube 152 and conduits 162/164. Base plate 180 may be formed from a steel plate that may be shaped into multiple planes, such as planes 182, 184, and 186. Base plate 180 may include mounting holes 181 that are configured to align with mounting holes of vacuum pump 120 and receive bolts therethrough to secure bearing vacuum pump 120 to base plate 180. As further shown in FIG. 5, base plate 180 may include support holes 188 that are configured to align with combined bracket/coupling guard 190 receive bolts therethrough to secure bracket/coupling guard 190 to base plate 180.

Motor 110 may be coupled to vacuum pump 120 along a rotating shaft (e.g., shaft 132). According to an implementation, motor 110 is mounted to vacuum pump 120 using combined bracket/coupling guard (or bearing cover) 190. Combined bracket/coupling guard 190 may include a protrusion 192 to support a portion of motor 110 against base plate 180 when coupling guard 190 is installed between vacuum pump 130 and the motor 110. When motor 110 is connected to shaft 132, bracket/coupling guard 190 may be secured over shaft 132 such that protrusion 192 may be rest on base plate 180 and receive bolts/screws through holes 188. Protrusion 192 may provide additional support against the weight of motor 110.

Figure 6:
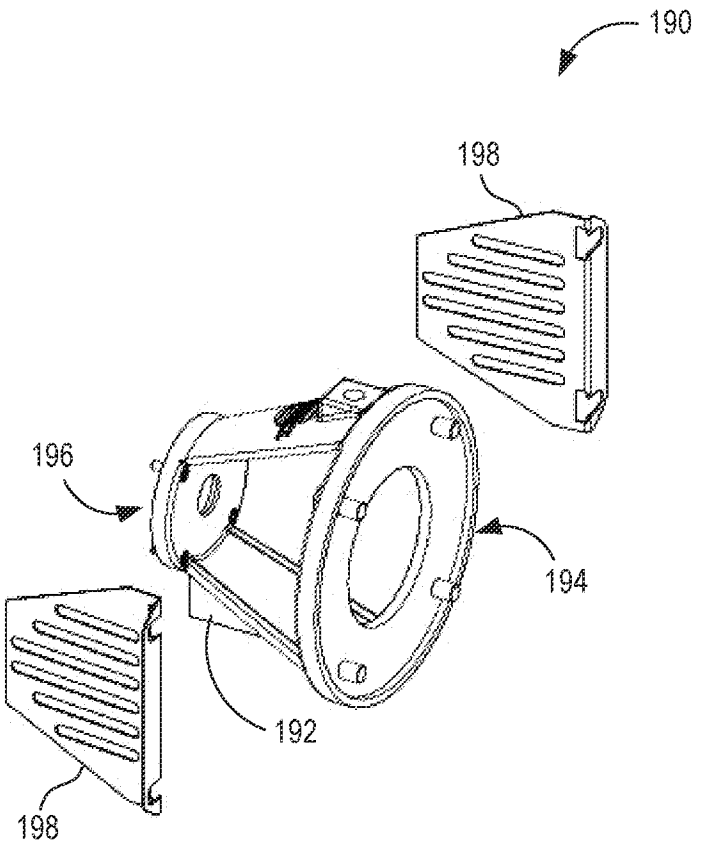
FIG. 6 is exploded view of a combined bracket/bearing cover for the vacuum priming system.

FIG. 6 is an exploded view of bracket/coupling guard 190. As shown in FIG. 6, for example, a motor end flange 194 of bracket/coupling guard 190 may be configured to attach to motor 110, and a pump end flange 196 of bracket/coupling guard 190 may be configured to attach to pump 130. Vented panels 196 may be attached to bracket/coupling guard 190. In one implementation, panels 196 may be secured to motor end flange 194 using bolts that also attach bracket/coupling guard 190 to motor 110.

Figure 9:
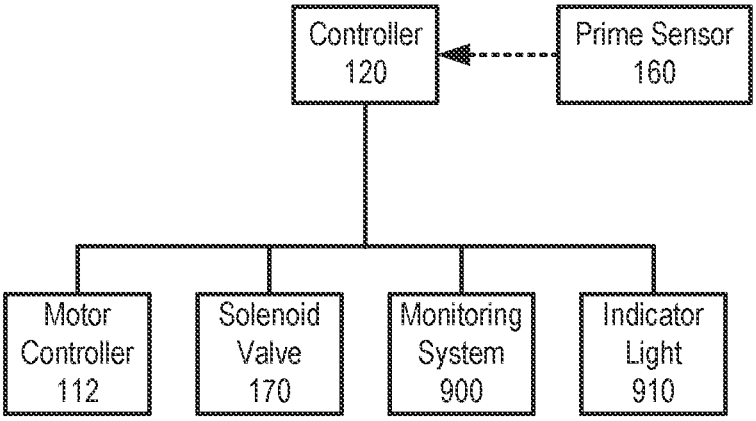
FIG. 9 a simplified block diagram of a control system for vacuum priming system 100.

FIG. 9 provides a simplified schematic of a control system for vacuum priming system 100. Controller 120 may include, for example, one or more programmable logic controllers (PLC) connected to motor controller 112, solenoid valve 170 (e.g., wired via conduit 164), a monitoring system 900, and an indicator 910. According to implementations described herein, communications among controller 120, prime sensor 160, motor controller 112, solenoid valve 170, and/or monitoring system 900 may be conducted using wired or wireless communications.

Monitoring system 900 (also referred to herein as a monitoring device) may include an Internet of Things device, a Machine Type Communication (MTC) device, a machine-to-machine (M2M) device, an enhanced MTC device (eMTC) (also known as Cat-M1), an end node employing Low Power Wide Area (LPWA) technology such as Narrow Band (NB) IoT (NB-IoT) technology, or some other type of wireless end node. According to various embodiments, monitoring system 900 may include hardware, such as a processor, ASIC, FPGA, or a combination of hardware and software (e.g., a processor executing software) to execute various types of functions. Monitoring system 900 may also include calibrated sensors to collect vibration, temperature, and/or other pump data (e.g., of centrifugal pump 10), and forward the collected data via a wireless interface (not shown) to backend systems or user devices. In one implementation, monitoring system 900 may also include sensor ports to receive data from external devices, such as controller 120. For example, controller 120 may provide data from motor 120 (e.g., on/off state data), solenoid valve 170, or prime sensor 160 to monitoring system 900. In one implementation, monitoring system 900 may be attached to centrifugal pump 10.

Indicator 910 may include one or more indicator lights (e.g., a LED, etc.) or other indicia to signal that vacuum priming system 100 is operating, for example. In another implementation, indictor 910 may include multiple colored lights (e.g., red, green, etc.) or other indicia. According to an embodiment, indicator 910 may be included with other components (e.g., a circuit board) of controller 120 and be visible through an opening in a housing of controller 120.

According to an implementation, controller 120 and prime sensor 160 may provide a closed loop feedback system. As described above, prime sensor 160 may provide a signal to controller 120 indicating a primed state (e.g., liquid detected, pressure detected, etc.) or unprimed state (e.g., no liquid detected, pressure detected, etc.). Controller 120 may receive signals from prime sensor 160 continuously, periodically, or whenever there is a change in state (e.g., from primed to unprimed or vice versa). In response to detecting a change in state from prime sensor 160, controller 120 may selectively activate or deactivate vacuum priming system 100.

When controller 120 detects that centrifugal pump 10 enters an unprimed state, controller 120 may activate vacuum priming system 100 to provide suction through suction assembly 150. For example, controller 120 may signal motor controller 112 to power up motor 110 and signal solenoid valve 170 to open. Additionally, in an implementation, controller 120 may turn on indicator 910 and send a signal to monitoring system 900 indicating an active state of vacuum priming system 100.

When controller 120 detects that centrifugal pump 10 enters a primed state, controller 120 may deactivate vacuum priming system 100 to prevent suction through suction assembly 150. For example, controller 120 may signal motor controller 112 to power down motor 110 and signal solenoid valve 170 to close. Additionally, in an implementation, controller 120 may turn off indicator 910 and send a signal to monitoring system 900 indicating an inactive state of vacuum priming system 100.

According to an implementation, controller 120 may include a delay timer to activate or deactivate vacuum priming system 100. For example, controller 120 may implement a delay when prime sensor 160 indicates a loss of prime to avoid unnecessary cycling of vacuum priming system 100. According to an implementation where liquid or pressure levels are provided, controller 120 may require multiple consecutive readings above (or below) a threshold before enacting a priming operation. In other implementations, controller 120 may apply event detection algorithms that include definitions of and responses to data from prime sensor 160. The event detection algorithms may include thresholds, hysteresis settings, or other values that may indicate a primed or unprimed state. The event detection algorithms may also define responses to each defined event, including forwarding data to monitoring system 900 or activating indicator 910 where applicable.

As described herein, a vacuum priming system is provided for a centrifugal pump. The system includes a vacuum pump, a motor coupled to the vacuum pump and configured to run the vacuum pump, a suction assembly, and a controller. The suction assembly includes a tube providing fluid communication between the vacuum pump and a volute casing of the centrifugal pump, a prime sensor, and a solenoid valve. The prime sensor is configured to detect when a liquid level in the volute casing reaches a primed state. The solenoid valve is configured to selectively permit fluid flow through the tube. The controller is configured to receive signals from prime sensor and control the vacuum priming system. When the signals from the prime sensor indicate an unprimed state, the controller starts the motor and opens the solenoid valve to provide suction through the suction assembly. When the signals from the prime sensor indicate a primed state, the controller stops the motor and closes the solenoid valve to prevent suction through the suction assembly.

In contrast with the vacuum priming system disclosed herein, a traditional priming unit that is frame-mounted to a pump adds additional maintenance concerns, up-front cost, and installation constraints (e.g., larger footprint). The frame-mounted designs typically have the vacuum pump running continuously which causes undue wear and tear on the vacuum pump, leading to more-frequent repairs and replacement. Furthermore, the existing frame-mounted designs do not have remote monitoring capabilities.

The vacuum priming system described herein is more energy efficient than a conventional tie-in system that runs off the same shaft that runs the main pump. Running the vacuum pump in the traditional tie-in set up would draw wasted power (e.g., a continuous draw of between 0.5 HP to 2 HP). The system and methods described herein reduce the power required and only pull power during priming, reducing power consumption over the lifetime of the pump system and improving efficiency.

Embodiments described herein have been described in the context of using a controller (e.g., controller 120) to regulate operation of vacuum priming system 100. However, in other embodiments, vacuum priming system 100 may be implemented as a manual system, without controller 120, prime sensor 160, and solenoid valve 170. Thus, the foregoing description of embodiments provides illustration, but is not intended to be exhaustive or to limit the embodiments to the precise form disclosed. Accordingly, modifications to the embodiments described herein may be possible. For example, various modifications and changes may be made thereto, and additional embodiments may be implemented, without departing from the broader scope of the invention as set forth in the claims that follow. The description and drawings are accordingly to be regarded as illustrative rather than restrictive.

As set forth in this description and illustrated by the drawings, reference is made to "an exemplary embodiment," "an embodiment," "embodiments," etc., which may include a particular feature, structure or characteristic in connection with an embodiment(s). However, the use of the phrase or term "an embodiment," "embodiments," etc., in various places in the specification does not necessarily refer to all embodiments described, nor does it necessarily refer to the same embodiment, nor are separate or alternative embodiments necessarily mutually exclusive of other embodiment (s). The same applies to the term "implementation," "implementations," etc.

The terms "a," "an," and "the" are intended to be interpreted to include one or more items. Further, the phrase "based on" is intended to be interpreted as "based, at least in part, on," unless explicitly stated otherwise. The term "and/or" is intended to be interpreted to include any and all combinations of one or more of the associated items. The word "exemplary" is used herein to mean "serving as an example." Any embodiment or implementation described as "exemplary" is not necessarily to be construed as preferred or advantageous over other embodiments or implementations.

Use of ordinal terms such as "first," "second," "third," etc., in the claims to modify a claim element does not by itself connote any priority, precedence, or order of one claim element over another, the temporal order in which acts of a method are performed, the temporal order in which instructions executed by a device are performed, etc., but are used merely as labels to distinguish one claim element having a certain name from another element having a same name (but for use of the ordinal term) to distinguish the claim elements.

No element, act, or instruction used in the description of the present application should be construed as critical or essential to the invention unless explicitly described as such.

What is claimed is:

1. A vacuum priming system for a centrifugal pump, the system comprising:

a vacuum pump;

a motor coupled to the vacuum pump and configured to run the vacuum pump;

a suction assembly including a volute end section configured for connection to a volute casing of the centrifugal pump and a vacuum end section for connection to the vacuum pump, wherein the suction assembly includes:

a tube located between the volute end section and the vacuum end section, the tube configured for providing fluid communication between the vacuum pump and the volute casing of the centrifugal pump, a prime sensor connected at the volute end section, the prime sensor configured to detect when a liquid level in the volute casing reaches a primed state, a solenoid valve connected at the volute end section between the prime sensor and the tube, the solenoid valve configured to selectively permit fluid flow through the tube, and a water separator connected at the vacuum end section, the water separator configured to prevent moisture from entering the vacuum pump, and wherein the water separator comprises a check valve configured to release collected water when there is no suction in the suction assembly; and a controller including logic to:

receive signals from the prime sensor, start the motor and open the solenoid valve to provide suction through the suction assembly when the signals from the prime sensor indicate an unprimed state, and stop the motor and close the solenoid valve to prevent suction through the suction assembly when the signals from the prime sensor indicate the primed state.

2. The system of claim 1, wherein the prime sensor includes a liquid level sensor inserted at a high-point of the volute casing.

3. The system of claim 1, wherein the prime sensor includes a pressure sensor to detect a discharge pressure of the centrifugal pump.

4. The system of claim 1, wherein the controller is configured to receive the signals from the prime sensor via a wired connection.

5. The system of claim 1, wherein the signals from the prime sensor that indicate the unprimed state include multiple consecutive signals.

6. The system of claim 1, wherein the vacuum priming system is configured to be mounted separately from the centrifugal pump.

7. The system of claim 6, wherein the vacuum priming system is physically connected to the centrifugal pump via the suction assembly.

8. The system of claim 1, wherein the vacuum pump includes:

a shaft disposed through an oil reservoir and coupled to the motor, and an oil delivery system including at least one member extending outwardly from the shaft, the at least one member being positioned relative to the oil reservoir so as to sling oil upwardly from the oil reservoir upon rotation of the shaft.

9. The system of claim 1, wherein the suction assembly further comprises:

a strainer that is configured to catch contamination exiting from the volute casing.

10. The system of claim 9, wherein the strainer is a y-strainer configured to be connected between the volute casing and the tube.

11. The system of claim 1, wherein the controller is configured to send actuation signals to the solenoid valve via a wired connection.

12. The system of claim 1, wherein the water separator is connected between the vacuum pump and the tube.

13. The system of claim 1, further comprising:

a base plate configured for securing the vacuum pump and the controller thereon, and a coupling guard configured to be installed between the vacuum pump and the motor, wherein the coupling guard includes a protrusion to support a portion of the motor against the base plate when the coupling guard is installed between the vacuum pump and the motor.

14. The system of claim 1, wherein the controller further includes:

a communication interface configured to connect to a monitoring device, and wherein the controller is further configured to provide data from the motor, solenoid valve, or prime sensor to the monitoring device.

15. The system of claim 1, wherein the controller further includes:

an indicator, wherein the controller is further configured to display the indicator when the motor is operating.

16. A system comprising:

a centrifugal pump including a volute casing with an opening;

a vacuum pump;

a motor coupled to the vacuum pump;

a suction assembly, including a volute end section configured for connection to the volute casing of the centrifugal pump and a vacuum end section for connection to the vacuum pump, wherein the suction assembly includes:

a tube located between the volute end section and the vacuum end section, the tube configured for providing fluid communication between the vacuum pump and the opening of the volute casing, a prime sensor connected at the volute end section, the prime sensor configured to detect a primed state in the volute casing and send signals to a controller for the vacuum pump, a solenoid valve connected at the volute end section between the prime sensor and the tube, the solenoid valve configured to selectively permit fluid flow through the tube, and a water separator connected at the vacuum end section, the water separator configured to prevent moisture from entering the vacuum pump, and wherein the water separator comprises a check valve configured to release collected water when there is no suction in the suction assembly; and the controller for the vacuum pump, the controller including logic to:

start the motor and open the solenoid valve to provide suction through the suction assembly when the controller does not receive signals from the prime sensor that indicate the primed state, and stop the motor and close the solenoid valve to prevent suction through the suction assembly when the controller receives signals from the prime sensor that indicate the primed state.

17. The system of claim 16, wherein the prime sensor includes one of:

a liquid level sensor, or a discharge pressure sensor.

18. The system of claim 16, further comprising:

a strainer connected between the volute casing and the tube, wherein the strainer is configured to catch contamination exiting from the volute casing.

19. The system of claim 16, further comprising:

a monitoring device, wherein the controller further includes a communication interface configured to provide data from the motor, solenoid valve, or prime sensor to the monitoring device.

20. The system of claim 16, wherein the prime sensor provides the signals to the controller periodically or whenever there is a change in the primed state.

* * * * *